United States Patent [19]

Rennert et al.

[11] Patent Number: 4,810,186

[45] Date of Patent: Mar. 7, 1989

[54] APPARATUS FOR BURNING FUELS WHILE REDUCING THE NITROGEN OXIDE LEVEL

[75] Inventors: Klaus-Dieter Rennert; Wolfgang Schreier, both of Gummersbach, Fed. Rep. of Germany

[73] Assignee: L. & C. Steinmüller GmbH, Gummersbach, Fed. Rep. of Germany

[21] Appl. No.: 903,987

[22] Filed: Sep. 4, 1986

[30] Foreign Application Priority Data

Sep. 4, 1985 [DE] Fed. Rep. of Germany ..... 3531571

[51] Int. Cl.[4] ..... F23D 1/00

[52] U.S. Cl. ..... 431/175; 431/9; 431/10; 110/345; 110/347

[58] Field of Search ..... 110/261, 262, 263, 264, 110/265, 345, 347; 431/8, 9, 10, 173, 175, 176

[56] References Cited

U.S. PATENT DOCUMENTS

| | | | |
|---|---|---|---|
| 1,776,841 | 9/1930 | Murray | 110/264 X |
| 3,224,419 | 12/1965 | Lowenstein et al. | 110/269 X |
| 4,294,178 | 10/1981 | Borio et al. | 431/173 X |
| 4,403,941 | 9/1983 | Okiura et al. | 431/10 |
| 4,438,709 | 3/1984 | Borio et al. | 110/347 |
| 4,669,398 | 6/1987 | Takahashi et al. | 110/347 |

FOREIGN PATENT DOCUMENTS

| | | | |
|---|---|---|---|
| 2837156 | 3/1979 | Fed. Rep. of Germany . | |
| 3021479 | 10/1982 | Fed. Rep. of Germany . | |
| 46905 | 4/1981 | Japan | 431/175 |
| 49803 | 5/1981 | Japan | 110/262 |
| 91108 | 6/1981 | Japan | 431/10 |
| 58-24706 | 2/1983 | Japan . | |
| 208304 | 11/1984 | Japan | 431/8 |
| 698939 | 10/1953 | United Kingdom | 110/262 |

OTHER PUBLICATIONS

"Proceedings of the 1982 Joint Symposium on Stationary Combustion NOx Control", vol. 1, Jul. 1983.

"Combustion Device", Abstract Japanese Pat. No. 59-9413, 1/84, Masai.

*Primary Examiner*—Samuel Scott

*Assistant Examiner*—Carl D. Price

*Attorney, Agent, or Firm*—Becker & Becker, Inc.

[57] ABSTRACT

A method and firing equipment for burning solid, liquid, or gaseous fuels, especially pulverized coal. The method includes the steps of tangentially introducing main fuel via main burners into a combustion chamber, where the fuel is burned, introducing reducing fuel via reduction burners into the combustion chamber to reduce the nitrogen oxides produced during the combustion of the main fuel, with the reducing fuel being burned under partial stoichiometric conditions, and, to ensure the burning-out of the fuel introduced into the combustion chamber, introducing burn-air above the feed of the main fuel and the reducing fuel, with a helically rising flow being provided in the combustion chamber. The reducing fuel of a given reduction burner is mixed, at a given distance from the opening of the associated main burner, with the curved afflux leaving that main burner for helical flow about the center of the combustion chamber.

8 Claims, 4 Drawing Sheets

APPARATUS FOR BURNING FUELS WHILE REDUCING THE NITROGEN OXIDE LEVEL

BACKGROUND OF THE INVENTION

The present invention relates to a method of burning solid, liquid, or gaseous fuels, especially coal dust or pulverized coal, and includes the steps of tangentially introducing main fuel via main burners into a combustion chamber, where the fuel is burned, introducing reducing fuel via reduction burners into the combustion chamber to reduce the nitrogen oxides produced during the combustion of the main fuel, with the reducing fuel being burned under partial stoichiometric conditions, and, to ensure the burning-out of the fuel introduced into the combustion chamber, introducing burn-out air above the feed of the main fuel and the reducing fuel, with a helically rising flow being provided in the combustion chamber. The present invention also relates to tangential firing equipment, especially for carrying out the aforementioned method; this equipment has a plurality of main burners oriented in conformity with a burning circle, a plurality of reduction burners, and a plurality of burn-out air nozzles disposed above the reduction burners.

A method of the aforementioned general type is known from the publication "Development of Mitsubishi" "Mact n-furnace $NO_x$-removal process for steam and generators" from "Proceedings of the 1982 joint symposium on stationary Combustion $NO_x$ control".

With the heretofore known way of carrying out such a method, there is formed in the combustion chamber, from the bottom toward the top, a main burner combustion zone, a nitrogen oxide reduction zone in which the reducing fuel is burned under partial stoichiometric conditions, and a burn-out zone above the feed for the burn-out air. With the heretofore known firing equipment for carrying out such a method, there are disposed in a given burner plane, i.e. in a vertical plane, one above the other a main burner, a reduction burner, and a burn-out air nozzle (see in particular FIG. 20 of the cited reference). It has been proven that the large-scale application of such a fuel stage encounters difficulties. For example, the gaseous and solid materials in the combustion chamber move upwardly along a helical path, so that when the reduction burner is disposed in the same vertical plane as the main burner or burners, there is no assurance that the reducing fuel can reduce the $NO_x$ that is formed further below, since the reducing fuel no longer comes into contact with this $NO_x$. Thus, with the heretofore known method the introduction of the reducing fuel is largely effected without taking into consideration the position of the primary flames in the lower portion of the combustion chamber in which the $NO_x$ is formed. This localized independence primarily involves drawbacks when, during partial-load operation, some of the burners are turned off, because then it is no longer possible to achieve a good intermixing between the fuel gases of the primary combustion zone and the reducing fuel.

Furthermore, the fact that the reduction burners are disposed above the main burners in the same burner plane requires a relatively high combustion chamber.

It is an object of the present invention to provide a method where on the one hand it is possible to achieve sufficient reduction of the nitrogen oxide level, and on the other hand even at partial load there is assured a good intermixing of the reducing fuel in the primary flames of the main burners.

SUMMARY OF THE INVENTION

The method of the present invention is characterized primarily in that the reducing fuel of a given reduction burner is mixed, at a given distance from the opening of the associated main burner, with the curved afflux leaving that main burner for helical flow in or about the center of the combustion chamber.

With the inventive way of carrying out the method, the feed of the reducing fuel is directly allocated to the individual main burners. In so doing, the flow vector of the curved and possibly already rising afflux is taken into consideration; in other words, the feed of the reducing fuel is coordinated with the afflux from the main burner in such a way that the intermixing with the reducing fuel is effected in the primary flame after termination of the gas reactions in order to reduce the nitrogen oxides formed in these gas reactions. In order to be able to achieve this, the introduction of the reducing fuel is effected in close proximity to the main burner, as a result of which the structural height of the combustion chamber can be reduced.

The air coefficient at the primary burner is preferably between 0.8 and 1.2, and after the intermixing of the reducing fuel should be between 0.6 and 1.0.

It is furthermore preferable that the ratio of primary fuel to secondary fuel be between 50:50 and 90:10.

In relation to the direction of rotation of the helical flow, the reducing fuel is preferably introduced in such a way that it is ahead of the main fuel. However, it is also possible to introduce the reducing fuel in such a way that it lags behind in relation to the direction of rotation. These relationships between the fuels can be achieved by altering the angle of introduction and/or the location of introduction.

It is possible to utilize the same fuel, preferably lignite, as the main fuel and the reducing fuel.

It can also be expedient to introduce the reducing fuel with air, which assists in the combustion; however, flue gas can also be used as the transport medium for the reducing fuel. Mixtures of air and flue gas are also conceivable.

As previously indicated, after termination of the reduction processes it is necessary to add burn-out air for the complete burning-out. In order here also to achieve a good intermixing in all load ranges, it is expedient to set the burn-out air independent of the number of operating burners and hence pulverizers. The regulation of the burn-out air is thus effected only as a function of load, with all burn-out air nozzles being supplied uniformly. It would also be possible to turn off individual ones of these air nozzles.

The firing equipment of the present invention is characterized primarily in that each of the reduction burners is disposed near, and is spaced at least to the side of, its associated main burner, and is oriented in such a way that during operation of the firing equipment, the reducing fuel introduced via the reduction burner is mixed at a given point into the primary flame of the associated main burner.

If with such tangential firing equipment at least two main burners are disposed in a single plane next to one another in a given combustion chamber wall, it is inventively proposed that the reduction burners associated with the two main burners be disposed between the two main burners. However, it is also possible to have a firing equipment configuration where the reduction burners associated with the two main burners are always disposed on the same side of the main burners.

If, in a known manner, the main burner comprises, arranged one above the other, a lower air inlet, a first fuel inlet, an intermediate air inlet having a high air pulse, a second fuel inlet, and an upper air inlet, it is expedient to correlate the lateral spacing and the orientation of the reduction burner with the intermediate air inlet.

The number and arrangement of the burn-out air nozzles can correspond to the number and arrangement of the main burners. However, it is also possible to have a greater number of burn-out air nozzles that are uniformly distributed about the combustion chamber.

The particular advantages of the inventive method come into operation when at least two main burners are disposed one above the other in a single vertical plane, with the two associated reduction burners again preferably being arranged in a vertical plane that is parallel to the plane of the main burners.

If during partial load some of the main burners are turned off, the associated reduction burners are, of course, also turned off.

Finally, it should also be noted that the inventive method can be used advantageously not only with tangential firing equipment having wall firing, but also with tangential firing equipment having corner firing.

Further specific features of the inventive method and firing equipment will be described in detail subsequently.

BRIEF DESCRIPTION OF THE DRAWINGS

This object, and other objects and advantages of the present invention, will appear more clearly from the following specification in conjunction with the accompanying schematic drawings, in which.

DESCRIPTION OF PREFERRED EMBODIMENTS

Figure 1:
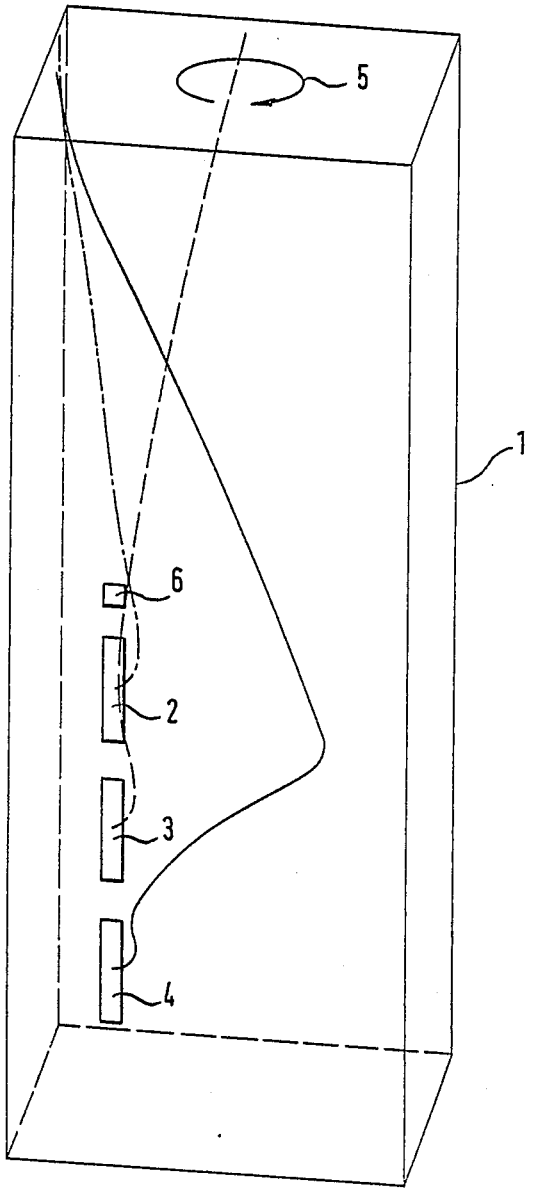
Fig.1 PRIOR ART
FIG. 1 is a perspective view of the combustion chamber of a prior art all-wall furnace, with the three superimposed main burners and the helical paths of the fuel associated with these burners, as well as the associated combusion products, of only one wall being illustrated.

Referring now the the drawings in detail, and in particular to the prior art of FIG. 1, shown are main burners 2, 3, and 4 that are arranged one above the other, in a single burner plane, in the rear wall of the combustion chamber 1 of an all-wall furnace or firing equipment. The main burners 2, 3, and 4 are oriented in conformity to the burning circle 5, which is illustrated schematically. The combustion products leaving the main burner 2 essentially describe the dot-dash line; the combustion products leaving the main burner 3 essentially describe the dashed line; and the combustion products leaving the main burner 4 essentially describe the solid line. If, for example, the reducing fuel were now introduced via a reductin burner 6 that is illustrated in FIG. 1 and is disposed in the same burner plane, the reducing fuel could not reduce the $NO_x$ that is produced in the primary flames of the bottom burners 3 and 4 because the reducing fuel essentially does not contact this $NO_x$.

Figure 2:
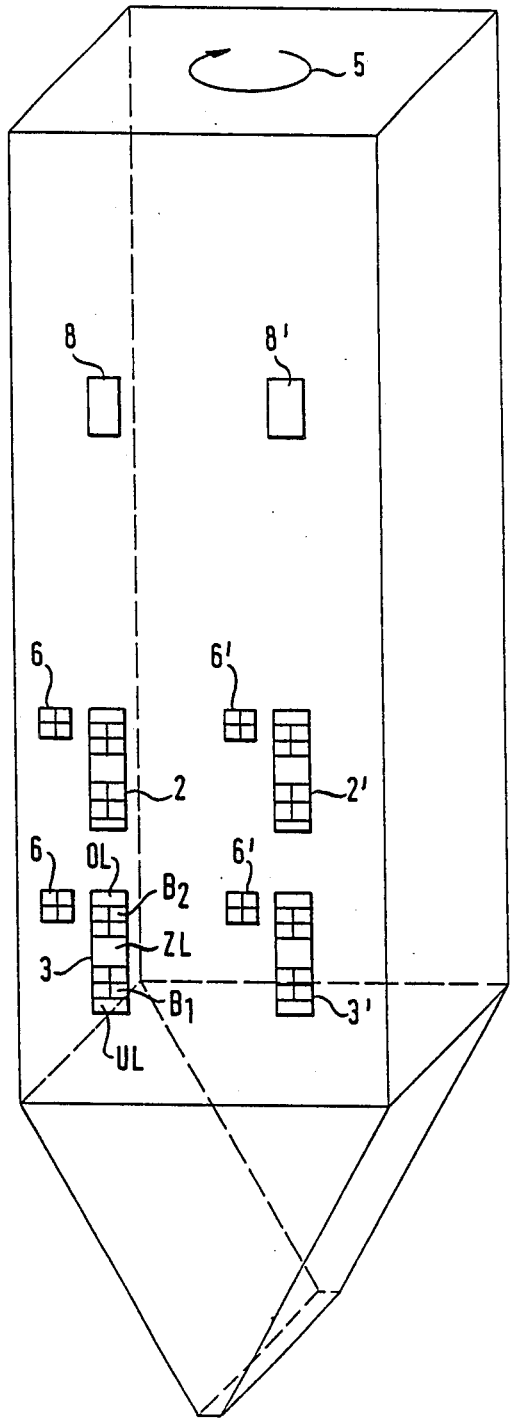
FIG. 2 illustrates one exemplary embodiment of the inventive tangential firing equipment, in a view similar to that of FIG. 1, whereby again the devices of only one wall are shown.
Figure 3:
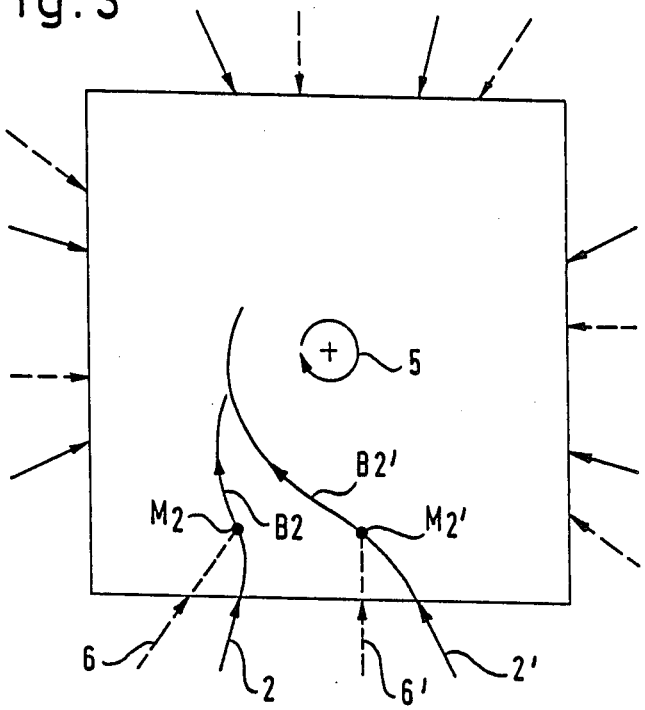
FIG. 3 is a schematic cross-sectional view to illustrate the fuel supply for the embodiment of FIG. 2.

In the embodiment illustrated in FIGS. 2 and 3, provided on each wall of the firing equipment are two adjacent main burners 2 and 2', and two adjacent main burners 3 and 3'; the burners 2 and 3 are disposed in one vertical plane, and the burners 2' and 3' are disposed in a different vertical plane. Each of the main burners comprises a lower air inlet UL, a first fuel inlet $B_1$, an intermediate air inlet ZL, a second fuel inlet $B_2$, and an upper air inlet OL. Associated with each of the four main burners 2, 2', 3, and 3' is a respective reduction burner 6 or 6'. With regard to the center of the intermediate air inlet ZL, these reduction burners are offset a certain amount upwardly and to the left.

As can be seen from FIGS. 2 and 3, the combustion products from the main burners 2 and 2' flow along curved and rising paths B2 and B2' inwardly and upwardly, i.e. upwardly out of the plane of the drawing of FIG. 3. The arrangement and orientation of the reduction burners 6 and 6' is such that the supplemental fuel is mixed into the primary flame at predetermined mixing points $M_2$ and $M_{2'}$, with these mixing points essentially representing the termination of the gas reactions in the primary flames.

At this point it should once again be indicated that the drawings serve only to explain the inventive concept, but do not represent any type of specific construction, with the structural elements being indicated only schematically.

Although in the just-described embodiment the reduction burners are offset upwardly, these burners could also be offset downwardly. In such a case, the burners would have to be oriented in conformity therewith.

Figure 5:
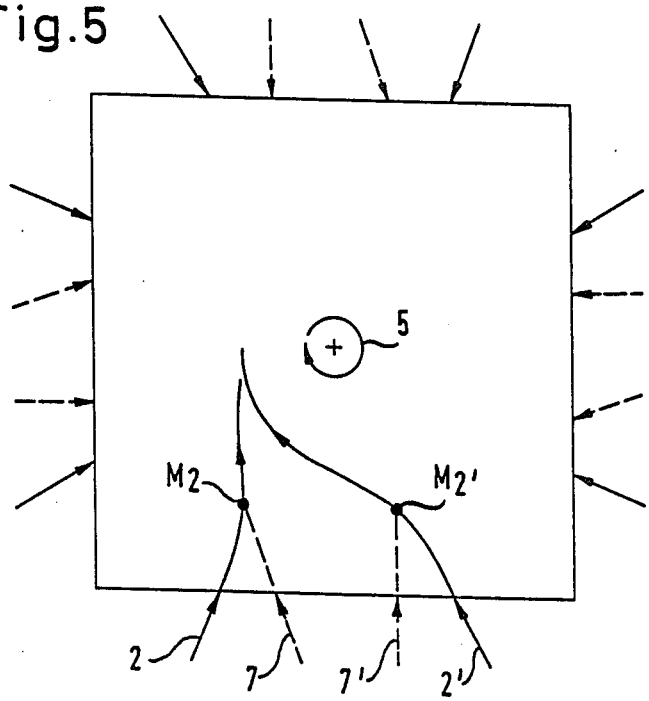
FIG. 5 is a cross-sectional view similar to that of FIG. 3 through the arrangement of FIG. 4.
Figure 4:
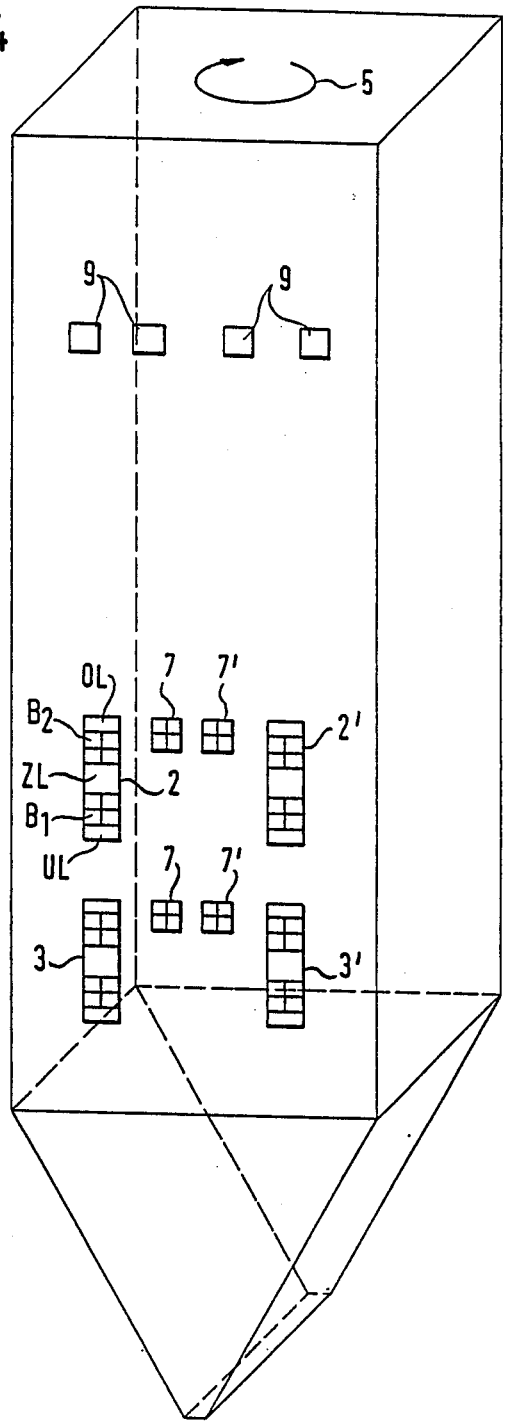
FIG. 4 is a view similar to that of FIG. 2 showing another inventive burner arrangement.

The second embodiment of FIGS. 4 and 5 utilizes some of the same reference numerals already described. This second embodiment differs from the first in that the reduction burners 7 and 7', rather than being disposed in each case on one side of the main burners, are disposed between the two burners.

In the embodiment of FIGS. 2 and 3, a respective final-combustion or burn-out air nozzle 8 and 8' is disposed in each plane of superimposed burners 2 and 3 or 2' and 3', whereas in the embodiment of FIGS. 4 and 5, a plurality of burn-out air nozzles 9 are provided that are not associated with the burners in any specific configuration. Of course, the configurations for the burn-out air nozzles can also be changed.

Finally, it should be noted that the inventive method is not limited to the special configuration of the main burners.

By disposing the reduction burners 6, 6', or 7, 7' to the sides of the main burners, a relatively low structural height is possible. During partial load, for example by turning off the main burners 2 and 2' together with the associated reduction burners 6 and 6', the nitrogen oxide reduction in the region of the burners 3 and 3' is not impaired, since the reducing fuel that is introduced via the reduction burners 7 and 7' that are associated with the main burners 3 and 3' is effectively mixed into the primary flames of the burners 3 and 3'.

The present invention is, of course, in no way restricted to the specific disclosure of the specification and drawings, but also encompasses any modifications within the scope of the appended claims.

What we claim is:

1. In tangential firing equipment having a combustion chamber with several walls, a plurality of main burners disposed in said walls and oriented in conformity with a burning circle, a plurality of reduction burners also disposed in said walls, and a plurality of burn-our air nozzles disposed above said reduction burners, the improvement wherein:

a respective one of said reduction burners is associated with a given one of said main burners, whereby each of said reduction burners is disposed near, and to a side of, an associated main burner, and is oriented in such a way that during operation of said firing equipment, reducing fuel introduced via that reduction burner is mixed at a given point into a primary flame of the associated main burner; and a given one of said walls of said combustion chamber is provided with at least two of said main burners in such a way that said main burners are disposed next to one another in the same plane; the reduction burners associated with said main burners are disposed between said main burners.

2. Firing equipment according to claim 1, which includes at least two main burners that are disposed one above the other in the same plane, with the reduction burners associated with said main burners being disposed in a vertical plane that is parallel to the plane of said main burners.

3. Firing equipment according to claim 1, in which the number and arrangement of said burn-out air nozzles corresponds to the number and arrangement of vertical rows of said main burners.

4. Firing equipment according to claim 1, in which the number of said burn-out air nozzles is greater than the number of vertical rows of said main burners, with said air nozzles being distributed uniformly about the combustion chamber of said firing equipment.

5. In tangential firing equipment having a combustion chamber with several walls, a plurality of main burners disposed in said walls and oriented in conformity with a burning circle, a plurality of reduction burners also disposed in said walls, and a plurality of burn-out air nozzles disposed above said reduction burners, the improvement wherein:

a respective one of said reduction burners is associated with a given one of said main burners, whereby each of said reduction burners is disposed near, and to a side of, an associated main burner, and is oriented in such a way that during operation of said firing equipment, reducing fuel introduced via that reduction burner is mixed at a given point into a primary flame of the associated main burner; and a given one of said walls of said combustion chamber is provided with at least two of said main burners in such a way that said main burners are disposed next to one another in the same plane; the reduction burners associated with said main burners are always on sides of said main burners that face in the same direction.

6. Firing equipment according to claim 5, which includes at least two main burners that are disposed one above the other in thet same plane, with the reduction burners associated with said main burners being disposed in a vertical plane that is parallel to the plane of said main burners.

7. Firing equipment according to claim 5, in which the number and arrangement of said burn-out air nozzles corresponds to the number and arrangement of vertical rows of said main burners.

8. Firing equipment according to claim 5, in which the number of said burn-out air nozzles is greater than the number of vertical rows of said main burners, with said air nozzles being distributed uniformly about the combustion chamber of said firing equipment.

* * * * *